US008587401B2

(12) United States Patent
Tong et al.

(10) Patent No.: US 8,587,401 B2
(45) Date of Patent: Nov. 19, 2013

(54) FUSE

(75) Inventors: Zhiwei Tong, Shenzhen (CN); Qing Lai, Shenzhen (CN); Jianhua Zhu, Shenzhen (CN)

(73) Assignee: BYD Company Limited, Shenzhen (CN)

( * ) Notice: Subject to any disclaimer, the term of this patent is extended or adjusted under 35 U.S.C. 154(b) by 270 days.

(21) Appl. No.: 13/097,053

(22) Filed: Apr. 28, 2011

(65) Prior Publication Data

US 2011/0267168 A1 Nov. 3, 2011

(30) Foreign Application Priority Data

Apr. 29, 2010 (CN) ..... 2010 2 0183749 U

(51) Int. Cl.
*H01H 85/04* (2006.01)

(52) U.S. Cl.
USPC ..... 337/407; 337/4; 337/5; 337/157; 337/159; 337/187; 337/403

(58) Field of Classification Search
USPC ..... 337/4, 5, 187, 299, 300, 403, 407, 157, 337/159
See application file for complete search history.

(56) References Cited

U.S. PATENT DOCUMENTS

| | | | | | |
|---|---|---|---|---|---|
| 2,300,142 | A | * | 10/1942 | Wood | 337/164 |
| 4,186,366 | A | * | 1/1980 | McVey | 337/407 |
| 4,527,144 | A | * | 7/1985 | Arikawa | 337/407 |
| 4,837,546 | A | * | 6/1989 | Bernstein | 337/272 |
| 4,850,014 | A | * | 7/1989 | Gillis et al. | 379/413.02 |
| 5,014,036 | A | * | 5/1991 | Komoto | 337/407 |
| 5,107,404 | A | * | 4/1992 | Tam | 361/818 |
| 5,298,877 | A | * | 3/1994 | Gurevich et al. | 337/164 |
| 5,831,507 | A | * | 11/1998 | Kasamatsu et al. | 337/4 |
| 5,854,583 | A | * | 12/1998 | Falchetti | 337/290 |
| 5,982,270 | A | * | 11/1999 | Wolfe et al. | 337/401 |
| 5,999,391 | A | * | 12/1999 | Lou et al. | 361/103 |
| 6,194,988 | B1 | * | 2/2001 | Yamaguchi et al. | 337/157 |
| 6,445,276 | B2 | * | 9/2002 | Schon et al. | 337/184 |
| D475,685 | S | * | 6/2003 | Cheng et al. | D13/161 |
| 6,583,711 | B2 | * | 6/2003 | Yang | 337/394 |
| 6,995,648 | B2 | * | 2/2006 | Jur et al. | 337/278 |
| 7,864,024 | B2 | * | 1/2011 | Schlenker et al. | 337/407 |

FOREIGN PATENT DOCUMENTS

JP 01204326 A * 8/1989 ..... H01H 37/76

* cited by examiner

*Primary Examiner* — Anatoly Vortman
(74) *Attorney, Agent, or Firm* — Squire Sanders (US) LLP

(57) ABSTRACT

A fuse includes an upper shell, a lower shell and a cavity formed by the upper shell and the lower shell; first and second conductors which are respectively disposed between the upper shell and the lower shell. The first ends of each conductors are disposed in the cavity and form a clearance. The second ends of the conductors extend out from the cavity. A conductive bar is welded to the first and second conductors to form a first weld line and a second weld line.

13 Claims, 9 Drawing Sheets

FUSE

CROSS-REFERENCE TO RELATED APPLICATIONS

This application claims the benefit of and priority to Chinese Application No. 201020183749.1, filed on Apr. 29, 2010, the content of which is incorporated by reference herein in its entirety.

FIELD

The present invention relates to a fuse.

BACKGROUND

A fuse is widely used by many circuits or systems to protect them from short circuit, overcurrent or overheating. The traditional fuse is based on the principle of reducing the cross-section area of a material with a high melting point so that the reduced cross-section area breaks before a peak value of a short circuit current arrives.

Current circuits or systems have more strict requirements for their protection, for example, the circuits or systems used in electric automobiles. In the electric automobile it may be required for the power battery to store a large amount of electric energy. As a result the power battery works under an environment of high temperature and strong vibrations. An electric automobile often works under an uncertain road condition as well as the potential threat of traffic accidents, so it is very important to protect the power battery from short circuit.

Because of the above factors, a quick fuse may be adopted by a battery module. The theory of the quick fuse is to reduce the conductive area of a fuse having a high melting point. Under normal working condition, the reduced conductive area does not break because of a balance among the thermal power, the heat exchange and the heat radiating power. But when short circuit occurs, the instant current may be so large that a large amount of heat is instantly produced at the reduced conductive area such that the heat does not dissipate fast enough, causing the reduced conductive area to melt instantaneously to cut off the circuit before the peak value of the short circuit current arrives.

But the traditional quick fuse has the following problems: high resistance; too fast response time that may cause the fuse to accidentally break; weak endurance which may not endure the high peak value of a pulse current. For example, in a pulse current heating system of an electric automobile, the peak value of the current may be too great for the traditional quick fuse.

SUMMARY

One object of the present invention is to solve some of the problems associated with the prior art, such as an accidental fuse break caused by a response time that is too fast, weak endurance against a higher peak value of a pulse current, and so on.

The embodiments of the present invention provide a type of fuse, which comprises an upper shell, a lower shell and a cavity formed by the upper shell and the lower shell; a first conductor and a second conductor which are disposed between the upper shell and the lower shell. The first end of each conductor is disposed in the cavity. The two first ends of the conductors form a clearance. The second ends of the conductors extend to the outside of the cavity. A conductive bar is welded with the first and second conductors to form a first weld line and a second weld line at both sides of the conductive bar that is disposed in the clearance. The resistivity of the first weld line and the second weld line is greater than the resistivity of the conductive bar. The fuse further has a first elastic element and a second elastic element, which are mounted on either the upper shell or the lower shell and are separate from each other. The first elastic element and the second elastic element are connected with the first and the second end of the conductive bar to push the conductive bar from the clearance.

When a large current flows through the fuse, because the resistivity of the first and the second weld lines is greater than the resistivity of the conductive bar, the temperature of the first and the second weld lines rises to reach or exceed the melting point of the solder that forms the first and the second weld lines. The first and the second weld lines then liquefy, and the linking strength between the conductive bar and the first and the second weld lines is reduced. As a result, the first elastic element and the second elastic push the conductive bar out of the clearance to cut the electric connection between the first conductor and the second conductor. The fuse according to the present invention is not only lower in resistance, stronger in overcurrent protection, better in enduring a pulse current, but also has a protective function against overloading and overheating. The fuse may break quickly and satisfy the requirements for enduring the pressure and the breaking ability when a short circuit occurs. Besides, the fuse according to the present invention is low in cost and simple to manufacture and assemble. And the parameters of the fuse such as current rating, breaking ability and melting characteristic may be easily adjusted by adjusting the resistivity of the weld lines.

DETAILED DESCRIPTION OF THE EMBODIMENT

Figure 1:
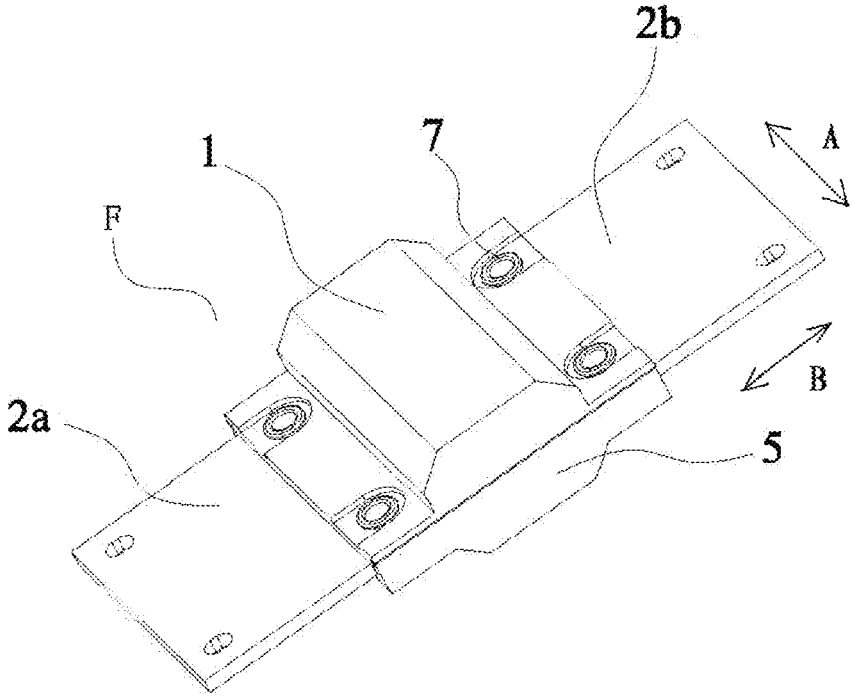
FIG. 1 is a perspective view of a fuse according to the present invention.

Reference will be made in detail to embodiments of the present disclosure. The embodiments described herein with reference to the accompanying drawings are explanatory and illustrative, which are used to generally understand the present disclosure. The embodiments shall not be construed to limit the present disclosure. The same or similar elements and the elements having same or similar functions are denoted by like reference numerals throughout the descriptions.

In the description, relative terms such as "lower", "upper", "up" as well as derivative thereof (e.g., "upwardly", etc.) should be construed to refer to the orientation as then described or as shown in the drawings under discussion. These relative terms are for convenience of description and do not require that the present disclosure be constructed or operated in a particular orientation.

Unless specified or limited otherwise, the terms "mounted," and "connected" and variations thereof are used broadly and encompass both direct and indirect mountings, connections, supports, and couplings.

In the following description, the fuse prepared according to the embodiments of the present invention may be named F. The fuse F according to embodiments of the present disclosure may be described below with reference to the drawings.

As shown in FIG. 1 to FIG. 7, a fuse according to an embodiment of the present invention may have an upper shell 1, a lower shell 5, a conductive bar 3, a first elastic element 4*a*, a second elastic element 4*b*, a first conductor 2*a* and a second conductor 2*b*.

The upper shell 1 may be integrated with the lower shell 5 to form a cavity Q. Both the upper shell 1 and the lower shell 5 may be made from one or more of insulating thermoplastic materials, such as PP (Polypropylene) and PPO (Polyphenylene oxide). The insulating thermoplastic materials may be injection molded to form the shells.

The first conductor 2*a* and second conductor 2*b* may be disposed between the upper shell 1 and lower shell 5. More specifically, the first end of the first conductor 2*a* (the right end shown in FIG. 2 to FIG. 4) and the first end of the second conductor 2*b* (the left end shown in FIG. 2 to FIG. 4) may be respectively placed in the cavity. The two ends may be positioned relative to each other in order to form a clearance. The second end of the first conductor 2*a* (the left end shown in FIG. 2 to FIG. 3) and the second end of the second conductor 2*b* (the right end shown in FIG. 2 to FIG. 3) may respectively extend out from the cavity Q along the landscape orientation B shown in FIG. 2 and play a role as the linking ends to connect an outside circuit.

Figure 6:
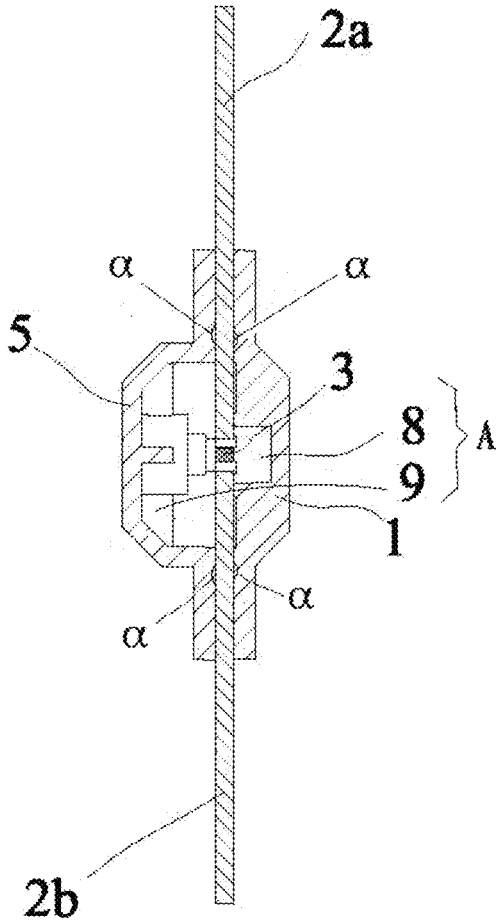
FIG. 6 is a C-C cross section view of FIG. 5.
Figure 7:
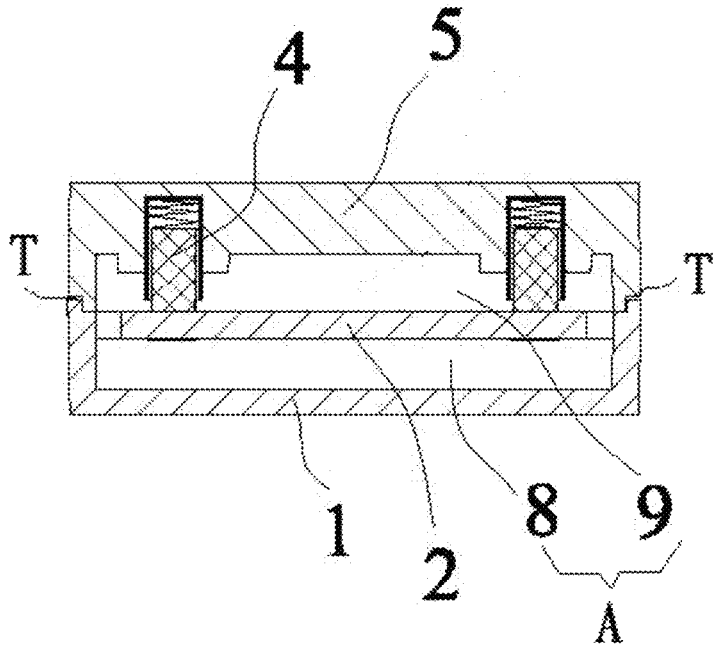
FIG. 7 is a D-D cross section view of FIG. 5.

As shown in FIG. 6 and FIG. 7, the cavity Q may be divided into the upper cavity 8 and the lower cavity 9 by the first conductor 2*a* and the second conductor 2*b*, and the clearance may be the path to connect the upper cavity 8 and lower cavity 9.

The conductive bar 3 may be placed into the clearance along the longitudinal direction A (the direction from left to right shown in FIG. 5) and then may be welded together with the first end of the first conductor 2*a* and the first end of the second conductor 2*b*. As a result, a first weld line 6*a* and a second weld line 6*b* may be formed at the two sides of the conductive bar 3. The resistivity of each weld line may be more than the resistivity of the conductive bar 3. The conductive bar 3 may be a cuboid with a rectangular cross section, optionally, a cube or round pole. The first conductor 2*a* and the second conductor 2*b* may be electrically connected through the conductive bar 3, the first weld line 6*a* and the second weld line 6*b*.

The conductive bar 3 may be made from a material of any suitable resistance, varying from a resistor to a conductor. For example, the conductive bar 3 may be made from a conductor material having the same resistance as the first and second conductors 2*a*, 2*b*. Alternatively, the resistance of the conductive bar 3 may be greater than that of the conductors 2*a*, 2*b* but is less than that of a nickel-chrome alloy. In some embodiments, the resistance of the conductive bar 3 may be sufficiently great to help prevent electric arcing between the first and second conductors 2*a*, 2*b*.

The first elastic element 4*a* and the second elastic element 4*b* may be respectively mounted on any one of the upper shell 1 and the lower shell 5. The two elastic elements 4*a*, 4*b* may be blocked off from each other on the longitudinal direction A. The first end and the second end of the conductive bar may be respectively connected with the first elastic element 4*a* and the second elastic 4*b*, and the first elastic element 4*a* and the second elastic element 4*b* may normally pull the conductive bar 3 apart from the clearance.

Figure 2:
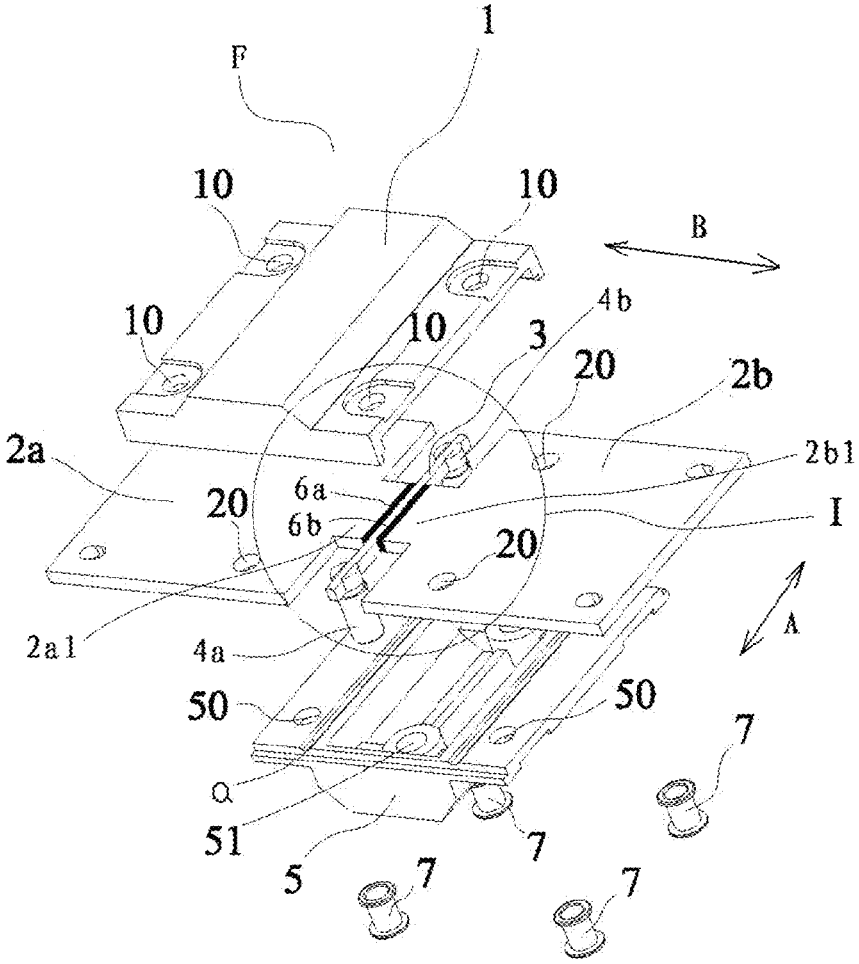
FIG. 2 is an exploded view of the fuse under normal working condition.
Figure 3:
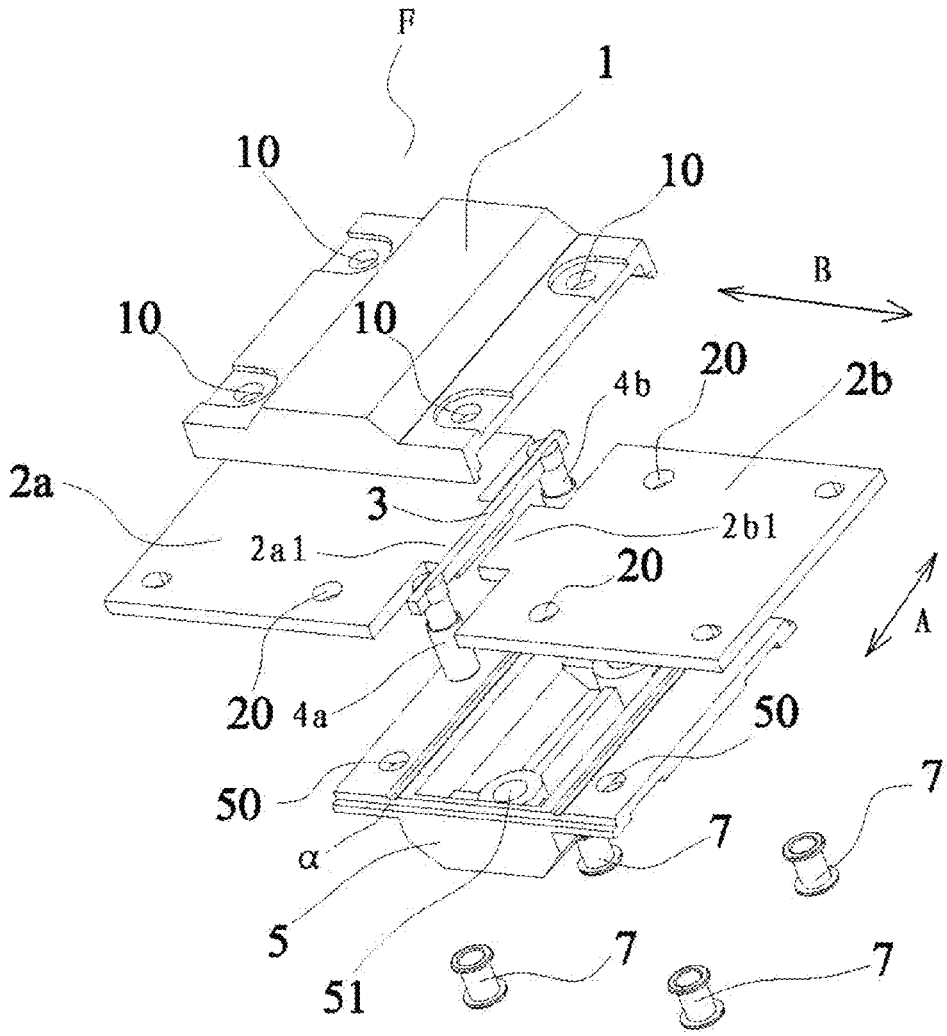
FIG. 3 is an exploded view of the fuse in a disconnected state.
Figure 4:
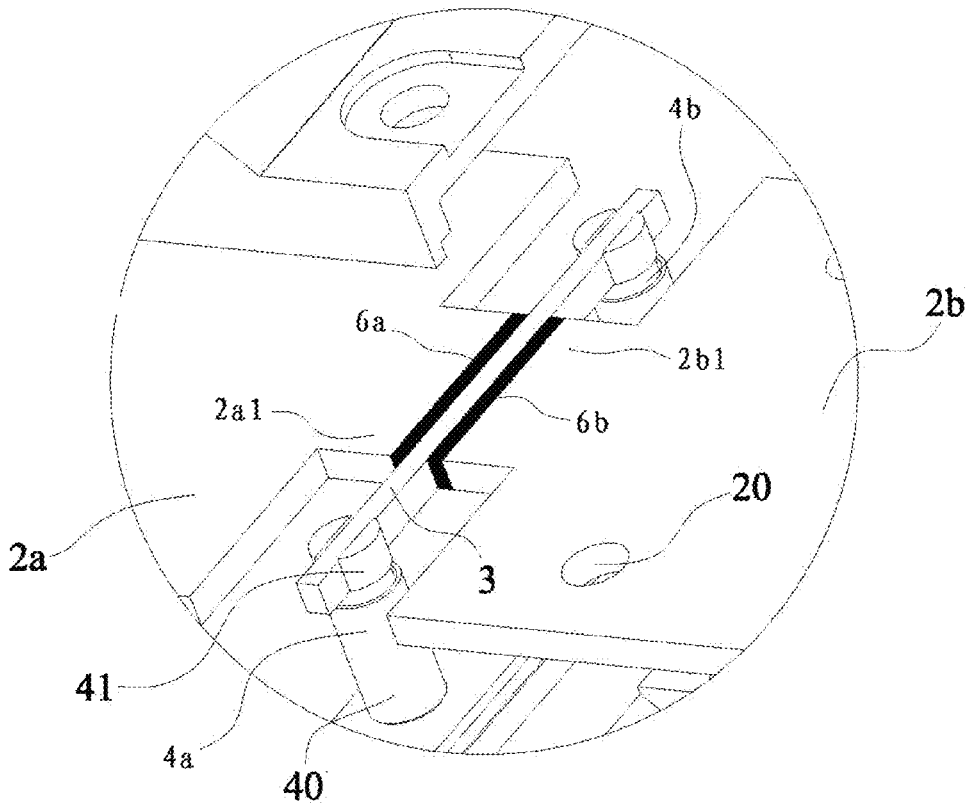
FIG. 4 is a partial view of FIG. 2.
Figure 5:
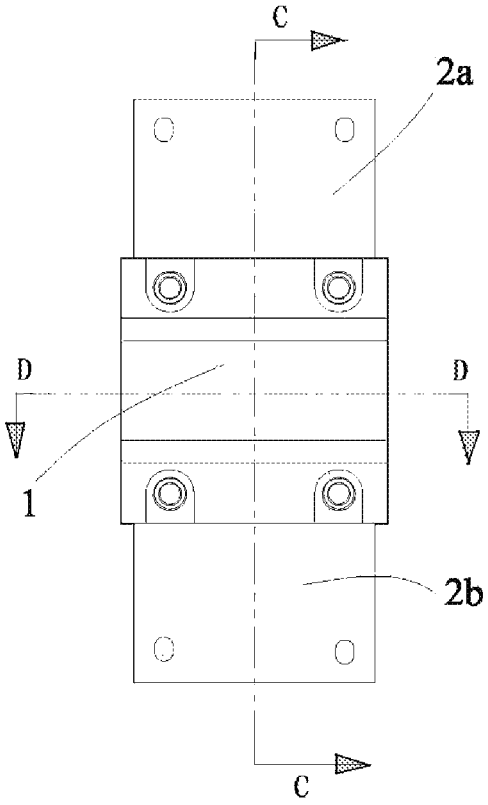
FIG. 5 is a front view of the fuse.

As shown in FIG. 2 to FIG. 4, according to an embodiment of the present invention, the lower ends of the first elastic element 4*a* and the second elastic element 4*b* may be mounted on the lower shell 5 while both the upper ends may respectively connect with the first and second ends of the conductive bar 3. Therefore, the two elastic elements 4*a*, 4*b* may act as a support for the conductive bar 3. Both the elastic elements 4*a* and 4*b* may impose an upward thrust on the conductive bar 3 to push it out from the clearance.

Normally, the first weld line 6*a* and the second weld line 6*b* may build a bridge to connect the conductive bar 3, the first conductor 2*a* and the second conductor 2*b*. The strength of the connection between the conductive bar 3 and the first, second weld lines 6*a*, 6*b* may be greater than the thrust imposed on the conductive bar 3 by the first and second elastic elements 4*a*, 4*b*. The conductive bar 3 stays within the clearance. When a short circuit causes an increased current, the first and second weld lines 6*a* and 6*b* may melt, and the connection strength among the first conductor 2*a*, the conductive bar 3 and the second conductor 2*b* may reduce. When the thrust on the conductive bar 3 imposed by the first elastic element 4*a* and the second elastic element 4*b* is greater than the connection strength among the first conductor 2*a*, the conductive bar 3 and the second conductor 2*b*, the conductive bar 3 may be pushed out from the clearance by the first elastic element 4*a* and the second elastic element 4*b* in order to cut the electricity connection between the first conductor 2*a* and the second conductor 2*b*.

In the fuse F according to an embodiment of the invention, the resistivity of both weld lines may be greater than the resistivity of the conductive bar 3. When a short circuit occurring, the electric current flowing through the first conductor 2*a*, the first weld line 6*a*, the conductive bar 3, the second weld line 6*b* and the second conductor 2*b* may increase, and the speed of temperature rise in both the weld lines 6*a* and 6*b* may be faster than that in the conductive bar 3. Accordingly, the temperature of both the weld lines 6*a* and 6*b* may reach the melt point in a short time, and the connection between the first conductor 2*a* and the conductive bar 3 and the connection the second conductor 2*b* and the conductive bar 3 may be severed. In this case, the conductive bar 3 may be removed from the clearance under the action of the first and the second elastic elements 4*a* and 4*b*, and the electric connection between the first elastic element 4*a* and the second elastic element 4*b* may be severed to cut off the current.

Hereby, the fuse F according to an embodiment of the invention may be small in resistivity, short in response-time, good in enduring the impact of a long pulse current, and low in cost. It may prevent overheating and is easy to manufacture, assemble and disassemble.

According to an embodiment of the present invention, the resistivity of the conductive bar 3 may be greater than or equal to the resistivity of both the first and second conductors 2*a*, 2*b*. When a short circuit occurs, compared with the conductive bar 3 and the first and second conductors 2*a*, 2*b*, the temperature of both weld lines 6*a* and 6*b* may rise rapidly and may be the first to reach the melt point. Therefore, the connection strength between the first conductor 2*a* and the conductive bar 3 and that between the second conductor 2*b* and the conductive bar 3 may drop, and the conductive bar 3 may be removed from the clearance under the action of the first and the second elastic elements 4*a* and 4*b*. The electric connection between the first elastic element 4*a* and the second elastic element 4*b* may be cut off, thus the protection from a short circuit may be achieved.

According to some embodiments of the invention, preferably, the conductive bar 3 may be braze-welded together with the first and the second conductors 2*a* and 2*b*, thus both the first and second weld lines 6*a*, 6*b* may be called a brazing seam. The tin-silver-copper solder or tin antimony solder may be used, and the purple copperplate may be used as the first and the second conductors 2*a* and 2*b*.

In the fuse F according to an embodiment of the invention, a clearance may be formed between the first conductor 2*a* and the second conductor 2*b*. When a large electric current flows through the first conductor 2*a* and the second conductor 2*b*, an electric arc may appear in the clearance. In order to eliminate the electric arc, an arc-eliminating material (not shown in relevant drawings) may be placed between the upper cavity 8 and lower cavity 9 to eliminate the damage caused by the electric arc when the connection between the first conductor 2*a* and the second conductor 2*b* is broken. The arc-eliminating material may be quartz sand.

According to some other embodiments of the invention, as shown in FIG. 1 to FIG. 4, the upper shell 1 and lower shell 5 may be riveted together by rivets 7. The first conductor 2*a* and the second conductor 2*b* may be respectively secured in between the upper shell 1 and the lower shell 5 by rivets 7. According to the embodiments shown by FIG. 1 to FIG. 4, four rivets 7 may be used. Four rivet holes 10 may be formed on the upper shell 1, the same, four rivet holes 50 may be formed on the lower shell 5. Two conductor rivet holes may be respectively formed on the first conductor 2*a* and the second conductor 2*b*. The upper shell rivet holes 10, the conductor rivet holes 20 and the lower shell rivet holes 50 may correspond with each other. Four rivets 7 may pass through the rivet holes to join the upper shell 1, the first conductor 2*a*, the second conductor 2*b* and the lower shell 5.

It is noticed that the invention may be not limited by the description. The upper shell 1 and the lower shell 5 may also be joined by a buckle structure or by bolts. The first conductor 2*a* and the conductor 2*b* may be joined with any one of upper shell 1 and lower shell 5 in any suitable manner. For example, the first conductor 2*a* may be jointed with the upper shell 1, and the second conductor 2*b* may be jointed with the lower shell 5.

As shown in FIG. 6, a sealing groove α may be formed on at least one of the joint surfaces of the upper shell 1 (the lower surface shown in FIG. 2) and the lower shell 5 (the upper surface shown in FIG. 2). According to the embodiment shown as FIG. 6, both the joint surfaces of the upper shell 1 and the lower shell 5 may have the sealing groove α. The sealing groove may be equipped with a sealing element (but not shown in the Figures), and the sealing element may be a sealing ring or some sealing material filled in the sealing groove α, such as the sealing adhesive (seal gum). Therefore the internal cavity Q may be waterproof and moisture-proof, and the fuse F may have a safe performance.

As shown in FIG. 7, in one embodiment of the present invention, a step structure T may be formed between the upper shell 1 and lower shell 5 to enhance the connection performance and seal effect.

As shown in FIG. 2 to FIG. 4, according to some embodiments of the present invention, preferably, the first end of the first conductor 2*a* has a first narrow part 2*a*1 that diminishes along the length direction A. Similarly, the first end of the second conductor 2*b* may have a second narrow part 2*b*1 that diminishes along the length direction A. The clearance may be between the first narrow part 2*a*1 and the second narrow part 2*b*1, and the first elastic element 4*a* and the second elastic element 4*b* may be respectively mounted in each end of the clearance. In this way, the length of the conductive bar 3 may be reduced, and the structure of the fuse F may be more compact.

According to some other embodiments of the present invention, preferably, the conductive bar 3 may be disposed on the center line of the clearance along the landscape orientation A. The first weld line 6*a* and the second weld line 6*b* may be symmetrical with respect to the longitudinal center line of the conductive bar 3. Therefore, the sizes of the first weld line 6*a* and the second weld line 6*b* may be nearly the same. When a short circuit occurs, both the first weld line 6*a* and the second weld line 6*b* may separate from the conductive bar 3 simultaneously.

As shown in FIG. 2, FIG. 3, FIG. 4, and FIG. 9, according to some embodiments of the present invention, the first elastic element 4*a* may include a fixing bucket 40, moving rod 41 and elastic component (not shown in Figures).

One end of the fixing bucket 40 may be sealed while another end is open. The fixing bucket 40 may be mounted on either the upper shell 1 or the lower shell 5, For example, the fixing bucket 40 may be mounted on the lower shell 5. The inner end (the lower end shown in FIG. 9) of the moving rod 41 may be movably set inside the fixing bucket 40 while the outer end (the upper end shown in FIG. 9) of the moving rod 41 may extend to the outside of the fixing bucket 40 in order to connect with the conductive bar 3. More specifically, a groove which may be used for clamping and connecting the end of the conductive bar 3 may be formed on the upper end of the moving rod 41. The elastic component such as a compressed spring may be set in the inside of the fixing bucket 40. Further, the elastic component may lie between the inner end of the moving rod 41 and the inner underside of the fixing bucket 40, in order to push the moving rod 41 in the up direction.

The second elastic element 4*b* may have the same structure as the first elastic element 4*a*, so the details are omitted here.

The first elastic element 4*a* and the second elastic element 4*b* may not be limited by the above embodiments. For example, the first elastic element 4*a* and the second elastic element 4*b* may also be a spring.

According to one embodiment of the invention, each of the first conductor 2*a* and the second conductor 2*b* may be a purple copper plate with good conductivity. The designed rated overcurrent capability may be about 300 A, the length (the size along the landscape orientation B) may be about 50 mm, the width (the side along the longitudinal direction A) may be about 40 mm, and the depth (the size in the vertical direction) may be about 2 mm. Other metals having good conductivity such as copper alloy, nickel, aluminum, and so on may be used to make the first conductor 2*a* and the second conductor 2*b*.

The conductive bar 3 may be made from purple copper such as phosphor-copper, copper alloy, nickel and aluminum, which satisfy the RoHs standard. The conductive bar may have a length (the size along the longitudinal direction A) of about 35 mm, a width (the size along the landscape orientation B) of about 1.5 mm, and a depth (the size in the vertical direction) of about 2 mm.

As shown in FIG. 4, according to one embodiment of the present invention, the clearance between the first narrow part 2*a*1 and the second narrow part 2*b*1 may have a width (the size along the landscape orientation B) range of about 2.0 mm to about 3.5 mm, and a length (the size along the longitudinal direction A) range of about 10 mm to about 15 mm.

It should be noted that the width of the weld line is the sum of the widths (the size along the landscape orientation B) of both the first weld line 6*a* and the second weld line 6*b*, the length of the weld line is the length (the size along the longitudinal direction A) of any one of the first weld line 6*a* and the second weld line 6*b*, the depth of the weld line is the depth (the size from upper to lower) of any one of the first weld line 6*a* and the second weld line 6*b*, and the conductive area is equal to the product of the length and depth of any one of the first weld line 6*a* or the second weld line 6*b*.

When the solder is given, the length of the weld line may be mostly related with the short circuit response time. The depth of the weld line and the response time may be further related with the strength of the weld line. For example, as to the electric automobile, the fusing time must be appropriate. Too fast a fusing time may cause erroneous actions, and too slow a fusing time may damage the power battery. The faster the fusing time is, the smaller the conductive area of the weld line. The wider the weld line is, the weaker the strength of the weld line is. Preferably, the weld line may have a length in the range of about 10 mm to about 15 mm, a width in the range of about 0.3 mm to about 1 mm. The depths of the first elastic element 4*a* and the second elastic element 4*b* may be the same as the depths of the first conductor 2*a* and the second conductor 2*b*. The width of the clearance may be equal to the sum of the widths of the conductive bar 3 and the weld line. The length of the clearance may be equal to the length of the first narrow part 2*a*1 or the second narrow part 2*b*1 along the longitudinal direction A, if both the first narrow part 2*a*1 and the second narrow part 2*b*1 exist.

The melting point and resistivity of the solder, the length and depth of the weld line, the resistivity of the conductive bar 3 may together determine the short circuit response time. The resistivity of the conductive bar 3 may be less than the resistivity of the solder, but may be greater than or equal to the resistivity of the conductor 2. When all the melting point of the solder, the material and size of the conductive bar are given, a change in the length of the weld line may effectively change the response time. Therefore, the method for changing the sizes for both the first narrow part 2*a*1 and the second narrow part 2*b*1 along the longitudinal direction may be used to adjust the length of the weld line conveniently, and the performance parameter of the fuse F may also be adjusted conveniently at the same time.

For example, according to one embodiment of the present invention, in order to design a fuse F with an overcurrent capability of about 300 A and a size suitable for the narrow space of the power battery for an electric automobile, considering the conductive ability and response speed of the fuse, solder with a melt point in the range of about 220° C. to 250° C. and resistivity in the range of about 800 to 1200% IACS may be used. A purple copperplate with a depth of about 2 mm and a width of about 35 mm to 45 mm may be used as the first conductor 2*a* and the second conductor 2*b*. The weld line may have a length in the range of about 10 mm to 15 mm and a width of about 0.3 mm to 1 mm For the purpose of manufacturability and the uniformity of the weld lines, the weld lines, the conductive bar 3, the first conductor 2*a* and the second conductor 2*b* may have the same depth.

When the solder is given, the larger the conductive area of the weld line is, the slower the melting of the fuse F may be; and the wider the width of the weld line is, the greater the resistance of the weld line may be, and the faster the melting of the fuse F may be. The strength of the weld line decreases as the width of the weld line increases. But the depth and length of the weld lines may be related to the first conductor 2*a* and the second conductor 2*b*. Therefore, based on the designed overcurrent capability, the response speed and the strength of the weld lines, the length, width and depth of the weld lines may be together taken into account.

By adjusting the dimensions, the melting time may be about 15 seconds to 30 seconds if the short circuit current is about 1700 A. When the short circuit current is about 4000 A, the melting time may be about 0.5 seconds to 1 second. Within the melting time, the conductive bar 3 may be removed from the clearance completely. The weld lines with an average depth of about 0.8 mm to 1.2 mm can withstand a voltage of about 1000V. Therefore, the withstand voltage, the breaking ability, response time, overcurrent ability and other parameters of the fuse F can satisfy the requirements of an electric automobile.

Below is a brief description of the manufacture process of the fuse F according to the invention.

Firstly, a first conductor 2*a*, a second conductor 2*b* and a conductive bar 3 are made according to the designed sizes.

The first conductor 2*a*, the second conductor 2*b* and the conductive bar 3 are put together with a fixture while ensuring the proper depth and tolerance of the first weld line 6*a* and the second weld line 6*b*.

The first conductor 2*a*, the second conductor 2*b* and the conductive bar 3 are joined using high frequency welding. The solder may be tin-silver-copper solder, tin-antimony solder, and so on.

The weld lines are grinded to ensure that the first weld line 6*a* and the second weld line 6*b* have a uniform thickness (the direction from top to bottom shown in FIG. 2).

The seal groove α is filled with a sealant. Then the upper shell 1 and the lower shell 5 are put together with the first conductor 2*a* and the second conductor 2*b* in between. The ends of the conductive bar 3 are respectively mounted on the first elastic element 4*a* and the second elastic element 4*b*.

The upper shell 1 and the lower shell 5 may be riveted together with the first conductor 2*a* and the second conductor 2*b* using rivets 7.

After a period of time, an arc-eliminating material is placed in the cavity A formed between the upper shell 1 and the lower shell 2 from a pre-molded hole. Then the pre-molded hole is sealed after the arc-eliminating material has filled almost 80% of the space of the cavity A.

Figure 8:
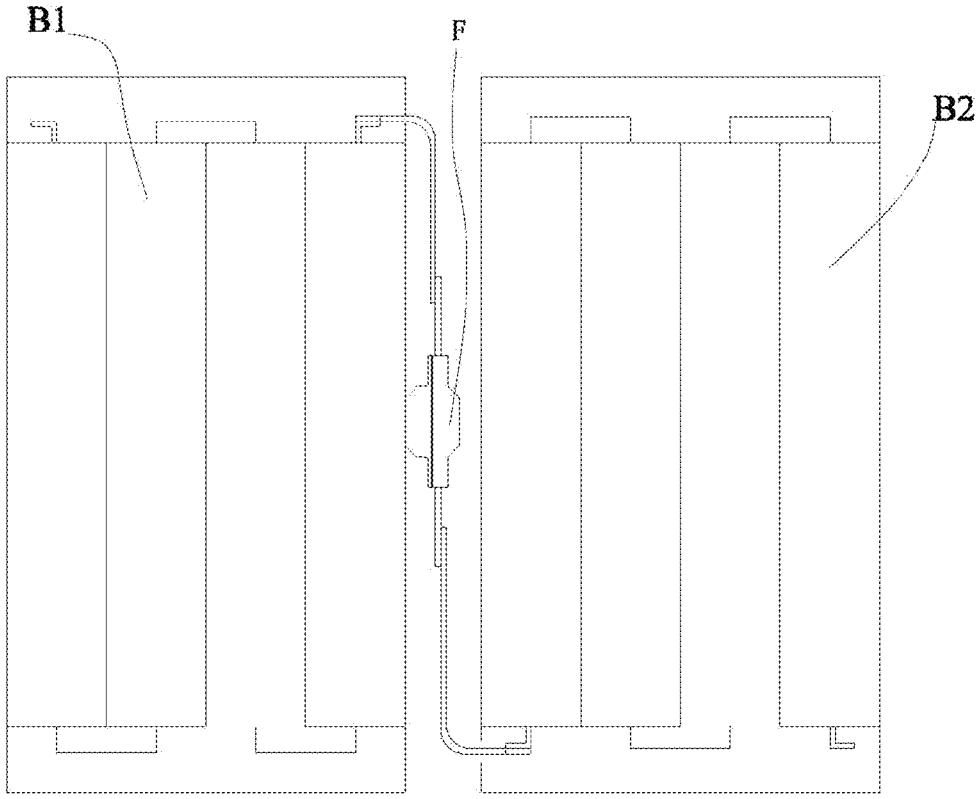
FIG. 8 is a schematic view of a power battery assembly having the fuse.
Figure 9:
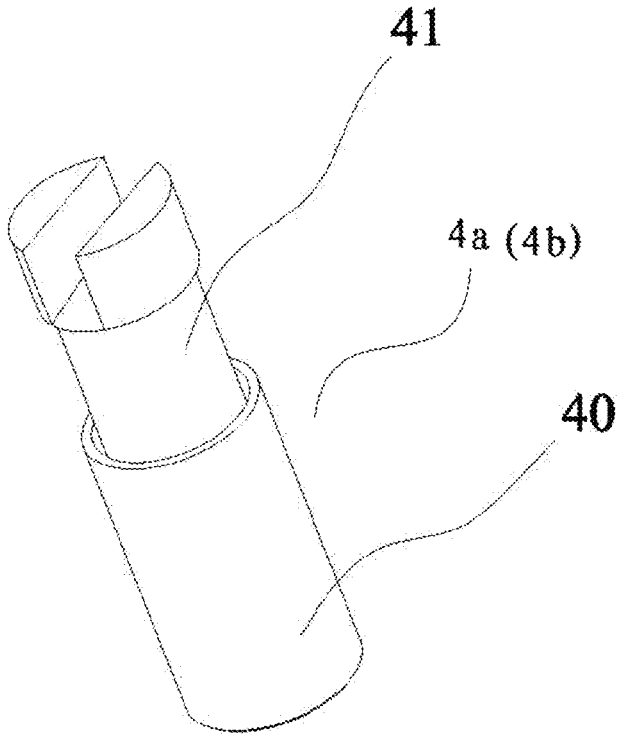
FIG. 9 is a schematic view of the elastic element of the fuse.

A fuse F according to the embodiments of the invention may be used in many kinds of overcurrent or overheating protection circuits and in the field of circuit protection in general. Additionally, the fuse may be used as a protection device for an electric automobile power battery. As shown in FIG. 8, a fuse F is linked in series with battery modules. The fuse F may be firstly mounted on a seat which is fixed to the side of the first module B1. Then the fuse F is connected to the first module B1 by laser welding, welding or other mechanical means of connection. Finally, the location of the second module B2 is adjusted, and the fuse F is connected to the second module B2 in the same manner as the one used to connect the fuse to the first module B1. In this way, not only the electrical connection between the first module B1 and the second module B2 but also the mounting of the fuse F are achieved.

When a short circuit occurs between the first module B1 and the second module B2, the current flowing through the fuse F may be great so that the temperature of the solder filled into the first weld line 6*a* and the second weld line 6*b* reaches or exceeds the solder's melting point within a few minutes. In this case, the first elastic element 4*a* and the second elastic 4*b* may push the conductive bar 3 out from the clearance. As shown in FIG. 3, when the fuse F is removed, the clearance with a width of about 0.8 mm to 1.2 mm ensures that the voltage of about 1000V cannot breakdown the gap. Therefore, the damage to the power battery modules caused by a short circuit may be reduced, and the potential danger faced by both human and environment may be avoided.

The fuse F according to embodiments of the invention may have the following advantages:

(1) Smaller Resistivity and Moderate Response Time

For example, if the weld lines have a conductive area of about 80 $mm^2$ and about 20 $mm^2$ to about 30 $mm^2$, a length of about 1.6 mm to about 2.4 mm, a resistance of about 0.03 mmho in theory and in fact of about 0.05 to 0.06 mmho, when the current is about 1700 A, the time for breaking the circuit is about 15 to 30 seconds. When the current is about 4500 A, the time for breaking the circuit is about 0.5 seconds to 1 second. For a single power battery, when the current is about or exceeds 4500 A, the breaking time may be more than 10 seconds. Therefore, the fuse F may satisfy the requirements of both a single power battery and a power battery module when they encounter a short circuit.

(2) The Fuse can Endure the Long-Time Impact of a Pulse Current

Because of different geographic areas in which automobiles are used, in some areas, a pulse-current temperature control system is used. Because the pulse current may have a great I×I×t value, a traditional fuse may not satisfy the requirement. A fuse F according to the present invention may be small in resistance, large in the bulk of solder, and small in the instant temperature rise of the solder under a pulse current, and can reach a temperature balance through the heat exchange between pulses of a pulse current, so that the fuse F according to the invention can effectively endure the cyclic impact of a pulse current.

(3) The Fuse can Effectively Avoid Damage Caused by Electric Arc

The two conductors and the two weld lines may be sealed between the upper shell and the lower shell. Therefore the cavity formed may have a sealing property, and the filling of an arc-eliminating material may avoid damage caused by electric arc.

(4) The Fuse has an Over-Heat Protective Function and is Simple to Manufacture and Assembly and Low in Cost.

When the current or the outside temperature is so high such that the solder reaches or exceeds the melting point of the solder, the fuse F breaks automatically to protect the circuit. Additionally, the fuse F according to the invention is low in material cost, simple to manufacture and assemble and easy to adjust the performance parameters of the fuse F.

Reference throughout this specification to "an embodiment" or "some embodiments" means that a particular feature, structure, material, or characteristic described in connection with the embodiment or example is included in at least one embodiment or example of the disclosure. Thus, the appearances of the phrases such as "in some embodiments" in various places throughout this specification are not necessarily referring to the same embodiment or example of the disclosure. Furthermore, the particular features, structures, materials, or characteristics may be combined in any suitable manner in one or more embodiments or examples.

Although explanatory embodiments have been shown and described, it would be appreciated by those skilled in the art that changes, alternatives, and modifications all falling into the scope of the claims and their equivalents may be made in the embodiments without departing from spirit and principles of the disclosure.

What is claimed is:

1. A fuse according to the present invention comprising:

an upper shell, an lower shell; and a cavity formed by the upper shell and the lower shell;

a first conductor and a second conductor, which are respectively disposed between the upper shell and the lower shell, wherein first ends of conductors are disposed in the cavity and form a clearance having a clearance width measured from the first end of the first conductor to the first end of the second conductor, and wherein the second ends of conductors extend to the outside of the cavity along the landscape orientation;

a conductive bar disposed in the clearance and soldered with the first and second conductors to form respectively a first solder line and a second solder line, the conductive bar having a conductor bar width measured in the same direction as the clearance width, the conductor bar width being less than the clearance width; and a first elastic element and a second elastic element, each of which is mounted on one of the upper shell and the lower shell, wherein the first elastic element and the second elastic element are connected respectively with first and second ends of the conductive bar to push the conductive bar out of the clearance.

2. The fuse according to claim 1, wherein the resistivity of both the first solder line and the second solder line is greater than the resistivity of the conductive bar.

3. The fuse according to claim 1, wherein solder used in soldering the conductive bar to the first and second conductors is tin-silver-copper or tin-antimony.

4. The fuse according to claim 1, wherein the cavity is filled with an arc-eliminating material.

5. The fuse according to claim 4, wherein the arc-eliminating material is quartz sand.

6. The fuse according to claim 1, wherein each of the first elastic element and the second elastic element includes a fixing bucket mounted on one of the upper shell and the lower shell;

a moving rod having a first end movably disposed in the fixing bucket and a second end extending out of the fixing bucket to connect with the conductive bar; and an elastic component disposed in the fixing bucket and between the first end of the moving rod and an inner underside of the fixing bucket.

7. The fuse according to claim 1, wherein the first conductor and the second conductor are respectively riveted with the upper shell and the lower shell, and the upper shell and the lower shell are riveted with each other.

8. The fuse according to claim 1, wherein the first conductor and the second conductor are joined with the upper shell and the lower shell by means of bolts, and the upper shell and the lower shell are also joined with each other by means of bolts.

9. The fuse according to claim 1, wherein at least one of the upper shell and the lower shell has a seal groove, and a sealant is disposed in the seal groove.

10. The fuse according to claim 1, wherein the first ends of the first conductor and the second conductor form respectively a first narrow part and a second narrow part, and wherein the clearance is formed between the first narrow part and the second narrow part.

11. The fuse according to claim 1, wherein each of the first conductor and the second conductor is a purple copper plate.

12. The fuse according to claim 1, wherein the clearance width is about 2.0 mm to about 3.5 mm.

13. The fuse according to claim 1, wherein the conductive bar is disposed in the center of the clearance, so that the first solder line is symmetrical with the second solder line with respect to the conductive bar.

* * * * *